United States Patent [19]

Pfarrwaller

[11] Patent Number: 5,063,972

[45] Date of Patent: Nov. 12, 1991

[54] PROJECTILE ACCELERATOR FOR A LOOM

[75] Inventor: Erwin Pfarrwaller, Winterthur, Switzerland

[73] Assignee: Sulzer Brothers Limited, Winterthur, Switzerland

[21] Appl. No.: 573,470

[22] Filed: Aug. 27, 1990

[30] Foreign Application Priority Data

Sep. 15, 1989 [CH] Switzerland ..... 03364/89

[51] Int. Cl.[5] ..... D03D 49/32

[52] U.S. Cl. ..... 139/145; 139/142; 74/54

[58] Field of Search ..... 139/145, 196.2, 142, 139/439; 74/54

[56] References Cited

U.S. PATENT DOCUMENTS

| | | | |
|---|---|---|---|
| 2,813,549 | 11/1957 | Pfarrwaller | 139/145 |
| 4,223,703 | 9/1980 | Pfarrwaller et al. | 139/145 |
| 4,922,967 | 5/1990 | Pfarrwaller et al. | 139/145 |

FOREIGN PATENT DOCUMENTS

| | | |
|---|---|---|
| 0678468 | 7/1939 | Fed. Rep. of Germany . |
| 0313155 | 5/1956 | Switzerland . |
| 332768 | 11/1958 | Switzerland . |
| 0636656 | 6/1983 | Switzerland . |

*Primary Examiner*—Andrew M. Falik

*Attorney, Agent, or Firm*—Kenyon & Kenyon

[57] ABSTRACT

A projectile accelerator has a coupling transmission articulated between a cam follower lever and a picking lever which has two end positions. The projectile accelerator also has an eccentric rocker on the drive shaft which cooperates with a tensioning lug on the accelerating shaft in order to carry out a return motion of the picking lever without need for a large angular movement of the cam follower lever. The picking lever is able to traverse large angles of movement while the cam following lever traverses reduced angles of movement.

18 Claims, 4 Drawing Sheets

PROJECTILE ACCELERATOR FOR A LOOM

This invention relates to a projectile accelerator for a loom.

Heretofore, various types of accelerators have been used in looms for the picking of a projectile into and through a shed of a loom. For example, Swiss Patent 331,155 and corresponding U.S. Pat. No. 2,813,549 describe accelerators having a picking lever secured to a torsion rod which is driven by a cam secured on a drive shaft via a cam follower lever and a toggle joint. At picking, the relatively heavy cam follower lever, however, has to perform the complete movement of the picking lever. This requires substantial energy and power for acceleration and, after picking, for deceleration of the movement. This, therefore, requires a substantial consumption of energy and involves severe mechanical stresses and wear and increasing braking problems at the limits of loom performance.

Accordingly, it is an object of the invention to improve the construction of a projectile accelerator in order to increase loom performance and to reduce energy consumption and wear.

It is another object of the invention to improve loom performance and increase loom efficiency.

It is another object of the invention to provide a projectile accelerator of relatively simple compact construction which requires relatively small energy consumption.

Briefly, the invention provides a projectile accelerator for a loom having a drive shaft, a cam mounted on the drive shaft for rotation therewith, an accelerating shaft and a picking lever mounted on the accelerating shaft or torsion bar for movement therewith from a picking position to an end position in order to pick a projectile. In addition, the accelerator includes a pivotally mounted cam follower lever for following the cam during rotation of the drive shaft and a coupling transmission connected to and between one end of the cam follower lever an one end of the picking lever. This coupling transmission also includes a link which is movable from a first end position corresponding to the picking position of the picking lever to a second end position corresponding to the end position of the picking lever. Still further, the accelerator includes a tensioning means connected to the drive shaft for rotating the accelerating shaft in a direction to move the picking lever from the end position thereof into an intermediate position toward the picking position while also moving the link from the second end toward the first end position thereof.

During picking, the picking lever is movable through a maximum acceleration position between the two end positions thereof. The link of the transmission is articulated so as to be movable into a position coaxial with the picking lever when the picking lever is in this maximum acceleration position. In this respect, the picking lever and the link of the coupling transmission are in extended or straight positions relative to each other.

The introduction of the coupling transmission having two end positions greatly reduces the picking-associated movement of the relatively heavy cam following lever. Introduction of the tensioning means for rotating the accelerating shaft into the intermediate position which is located beyond the extended or straight position of the picking lever relative to the link helps to achieve a much improved geometry. In all, power consumption, forces and wear are reduced considerably and loom efficiency is correspondingly increased.

The cam arrangement of the accelerator can be provided by a relatively simple construction wherein the cam follower lever is provided with two rollers which both run on a single cam on the drive shaft. A simple construction of the tensioning means may be provided by use of an eccentric rocker on the drive shaft and a tensioning lug on the accelerating shaft. In one embodiment, the tensioning lug may be provided with a groove while the eccentric carries a pin for moving into the groove in order to move the picking lever into the picking position. Alternatively, the tensioning lug may be provided with a pin while the eccentric rocker has an arcuate fork-like guide for receiving the pin.

Very high loom performances can be achieved by means of a picking lever having a terminal part or member which acts directly without the interposition of any picking element on an impact surface of a projectile since this feature permits increased acceleration angles and, therefore, improved performance.

These and other objects and advantages of the invention will become more apparent from the following detailed description taken in conjunction with the accompanying drawings wherein:

FIG. 1*a* illustrates a side view of a projectile accelerator constructed in accordance with the invention;

FIG. 1*b* illustrates a side view of the accelerator of FIG. 1*a*;

FIG. 2 diagrammatically illustrates the movements of the components of a projectile accelerator as set forth in FIG. 1 *a;*

Figure 1B:
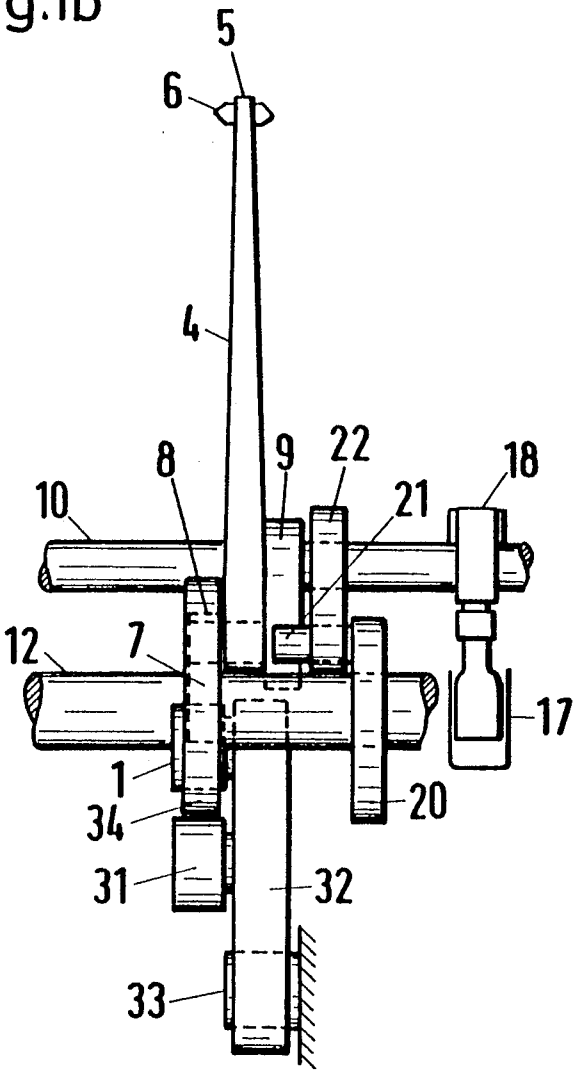
Figure 1A:
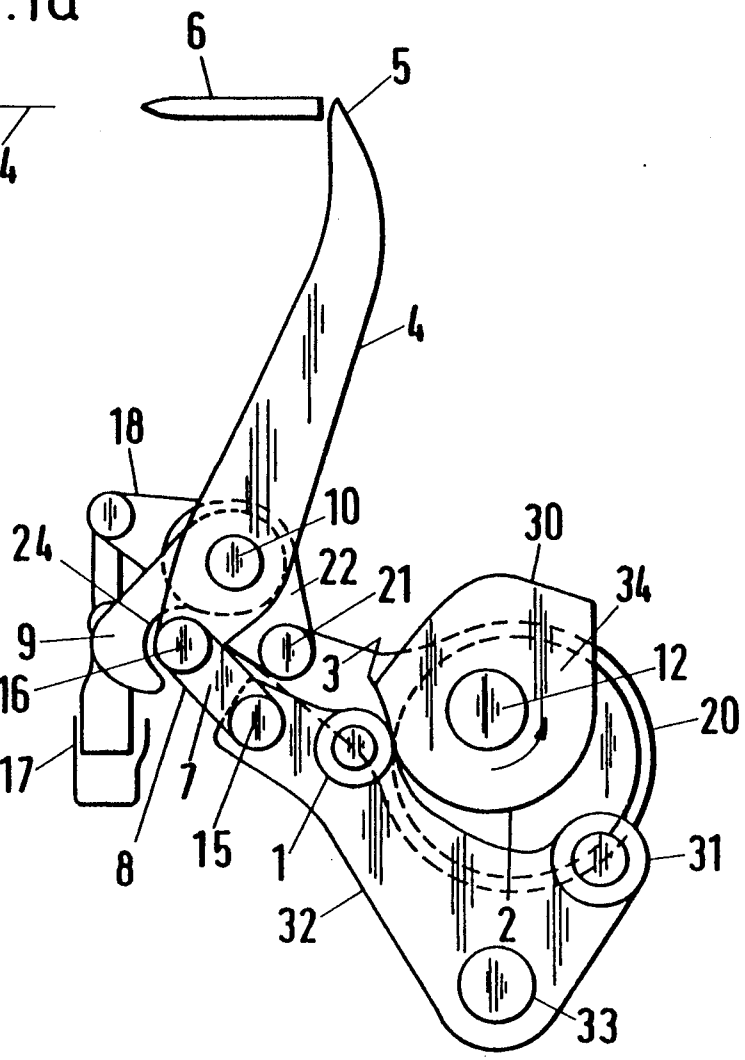

Referring to FIGS. 1*a* and 1*b*, the projectile accelerator for a loom includes a drive shaft 12 which is connected to the loom drive (not shown) in any suitable known manner. In addition, the accelerator includes an accelerating shaft 10 and a pivot shaft 33 secured in the loom frame in any suitable manner.

A picking lever 4 is fixedly mounted on the accelerating shaft 10 in order to move therewith from a picking position as shown in FIG. 1*a* to an end position to pick a projectile 6. As indicated, the picking lever 4 carries a terminal member 5 at the end for impacting on the projectile 6 during picking, for example, in the direction indicated by the arrow 14.

A cam 34 is mounted on the drive shaft 12 for rotation therewith while a cam follower lever 32 is pivotally mounted on the pivot 33 to follow the cam 34 during rotation of the drive shaft 12. To this end, the cam follower lever 32 has a pair of rollers 1, 31 mounted thereon. These rollers 1, 31 cooperate with two surfaces 2, 30 of the cam 34 in order to control the motion of the cam follower lever 32. In this respect, the foremost roller 1 as shown in FIG. 1*a*, cooperates with the locking and release surface or rise 2 of the cam 34 while the other roller 31 acts as a tensioning roller and cooperates with a tensioning surface or rise 30 on the cam 34.

A coupling transmission 8 is connected to and between one end of the cam follower lever 32 and one end of the picking lever 4 in order to transfer motion therebetween. As indicated, the coupling transmission 8 includes a link 7 which is pivotally connected by a toggle joint 15 to the cam follower lever 32 and which is pivotally connected by an anchor joint 16 to the picking lever 4. As indicated in FIG. 2, the transmission (link 7) is movable from a first end position 8*a* corresponding to the picking position of the picking lever 4 to a second end position 8*c* corresponding to the end position 4*c* of the picking lever 4.

Figure 2:
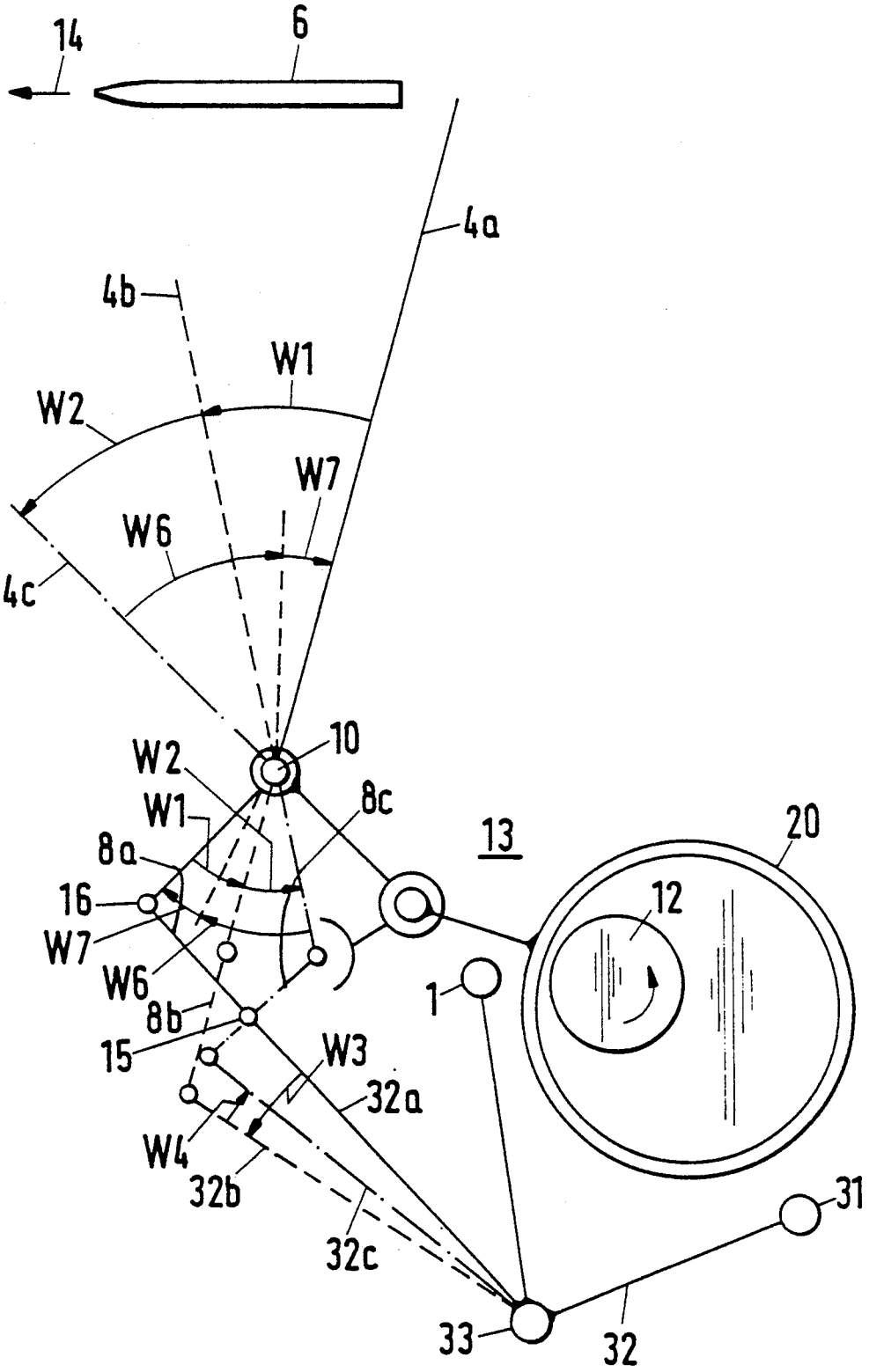

Referring to FIGS. 1*a* and 1*b*, a brake means is also provided to brake the movement of the picking lever 4 into the end position 4*c* (see FIG. 2). As illustrated, the brake means includes an arm 18 which is fixedly mounted on the accelerating shaft 10 and an oil brake 17 which is connected to the arm 18.

Figure 3:
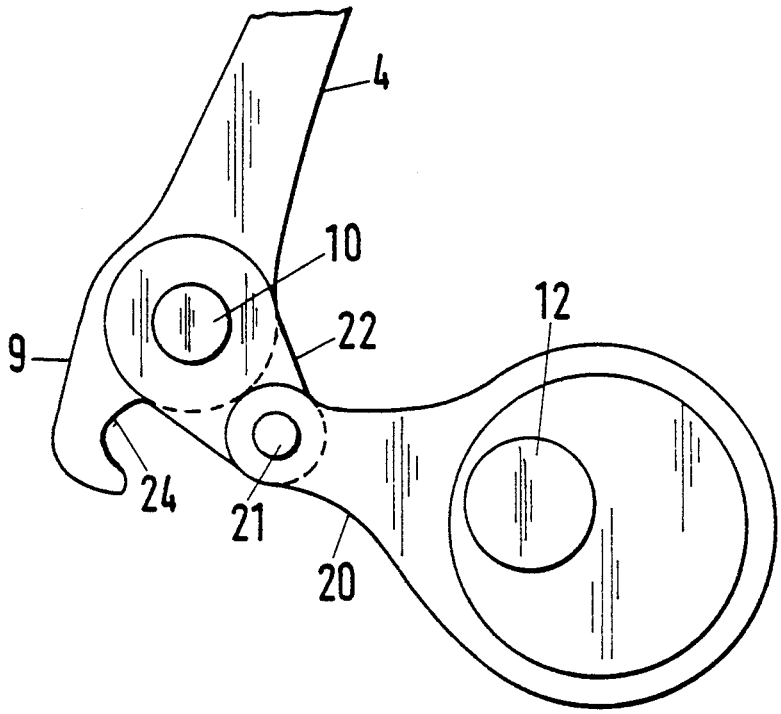
FIG. 3 illustrates a modified embodiment of a tensioning means for the picking lever in accordance with the invention.

A tensioning means 13 (see FIG. 2) is connected to the drive shaft 12 for rotating the accelerating shaft 10 in a direction to move the picking lever 4 from the end position (4*c*) thereof into an intermediate position toward the picking position (4*a*) and the link 7 from the end position 8*c* toward the initial end position (8*a*). As illustrated, the tensioning means 13 includes an eccentric rocker 20 on the drive shaft 12, a tensioning lug 9 fixedly mounted on the accelerating shaft 10, a link 22 pivotally mounted on the accelerating shaft 10 and a pin 21 connecting the rocker 20 to the link 22. As illustrated in FIG. 3, the pin 21 is sized to engage in a groove 24 in the tensioning lug 9. For purposes of simplicity, the tensioning lug 9 is shown as being integral with the picking lever 4 in FIG. 3.

FIG. 2 shows the accelerator in an initial position a with the coupling transmission in a first end position 8*a* before picking. The roller 1 on the cam follower lever 32*a* moves on the locking and release rise 2 of the cam 34 (see FIG. 1*a*) as far as the release position 3 thereof (FIG. 1A) and thus keeps the toggle joint 15 and picking lever 4 tensed. When the release position 3 is passed over, the toggle joint 15 bends, and the picking lever 4 moves through an angle W1 as far as position 4*b* and accelerates the projectile 6 to its maximum speed in the direction indicated by the arrow 14. In this position b, the transmission 8*b* has been extended by the second joint 16 and the cam follower lever 32*b* experiences a reversal of movement—i.e. the velocity of the lever is zero and, therefore, its kinetic energy is zero. In contrast to this, in conventional projectile accelerators, the heavy cam follower lever has received a substantial kinetic energy in this position which is lost for acceleration of the projectile.

Thereafter, the picking lever 4 is braked through the angle W2 by the oil brake 17 until stopping in the end position 4*c*; the coupling transmission reaching the second end position 8*c*. Consequently, while the picking lever 4 moves through very substantial angles W1, W2 very fast, as required, the movement of the cam follower lever 32 is reduced considerably as indicated by the small angles W3 and W4.

The subsequent tensioning of the picking lever or of the accelerating shaft 10 is produced by the tensioning means 13. During this time, the eccentric rocker 20 is moved by the drive shaft 12 so that the transmission with the joint 16 moves through an angle W6 to a point beyond the extended or straight position 8*b*.

Thereafter, the tensioning roller 31 on the lever 32 acts by way of the transmission 8 to further tension the picking lever over the angle W7 as far as the picking position 4*a*.

During picking, the picking lever 4 is moved to the maximum acceleration position 4*b* while at the same time, the link 7 of the coupling transmission 8 is movable into a position 8*b* coaxial with the picking lever 4 (see FIG. 2).

Figure 4:
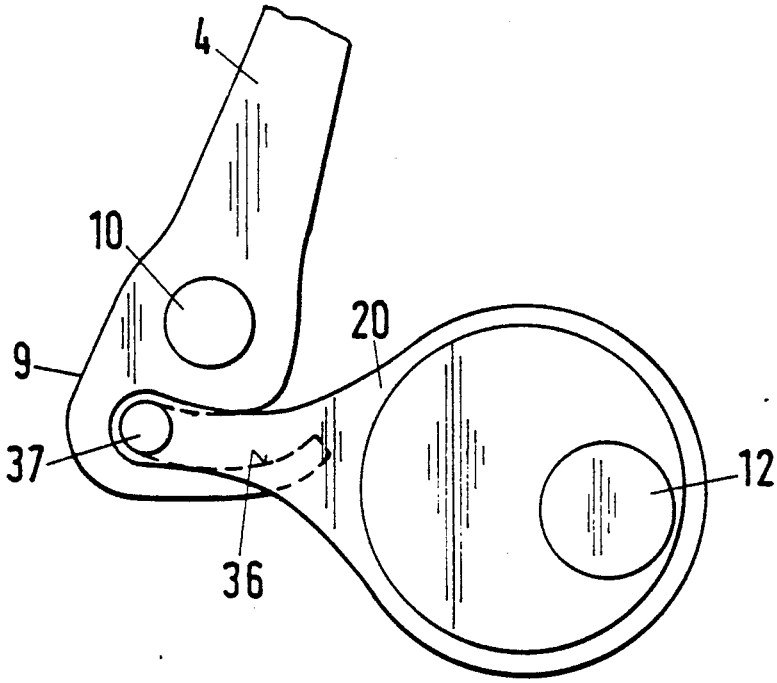
FIG. 4 illustrates a view of a further modified tensioning means in accordance with the invention.
Figure 5:
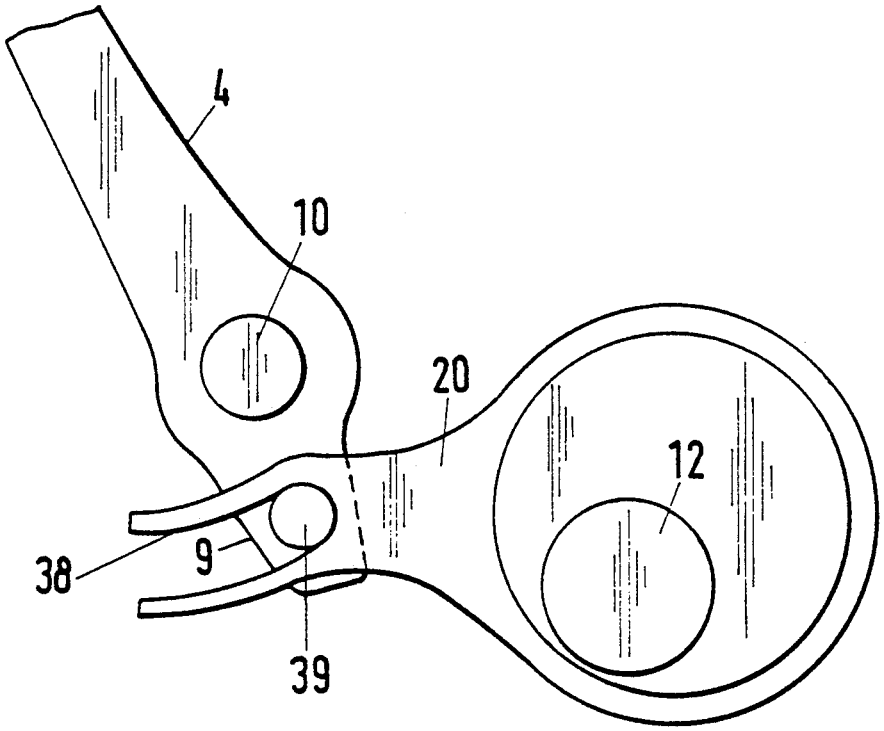
FIG. 5 illustrates a further modified tensioning means constructed in accordance with the invention.

Referring to FIG. 4, wherein like reference characters indicate like parts as above, the tension lug 9 may be provided with an arcuate guide groove 36 while the rocker 20 is provided with a pin 37 which engages in the groove 36. In a converse arrangement as shown in FIG. 5, the tensioning lug 9 may be provided with a pin 39 which projects therefrom into an arcuate fork-like guide 38 on the rocker 20 for receiving the pin 39. The arrangements lead to advantageous geometry, i.e. advantageous tensioning angles for both the tensioning means 13 itself and also for the residual tensioning of the picking lever 4 through the angle W7 (see FIG. 2) by means of the lever 32 and transmission 8.

The tensioning means provided by the invention provides for improved tensioning performances for less cost and wear. In this respect, the angle W7 can be very small, for example, just 1° to 2° whereas the angles W1 and W2 can have relatively large values, for example, of from 20° to 30° on direct picking.

The invention thus provides a projectile accelerator which permits an increase in loom performance and a reduction in energy consumption and wear. In addition, the invention provides a projectile accelerator which is able to increase the efficiency of a picking operation in a loom and, thus, the overall efficiency of a loom.

What is claimed is:

1. A projectile accelerator for a loom comprising a drive shaft;

a cam mounted on said drive shaft for rotation therewith;

an accelerating shaft;

a picking lever mounted on said accelerating shaft for movement therewith from a picking position to an end position to pick a projectile;

a pivotally mounted cam follower lever for following said cam during rotation of said drive shaft;

a coupling transmission connected to and betweenone end of said cam follower lever and one end of said picking lever, said transmission including a link movable from a first end position corresponding to said picking position to a second end position corresponding to said end position to said picking lever; and tensioning means connected to said drive shaft for rotating said accelerating shaft in a direction to move said picking lever from said end position thereof into an intermediate position toward said picking position and said link from said second end position toward said first end position thereof.

2. A projectile accelerator as set forth in claim 1 which further comprises a brake means to brake movement of said picking lever into said end position thereof.

3. A projectile accelerator as set forth in claim 2 wherein said brake mean is an oil brake coupled to said picking lever.

4. A projectile accelerator as set forth in claim 1 wherein said picking lever is movable through a maximum accelerating position between said end positions thereof and said link is movable into a position coaxial with said picking lever with said picking lever in said maximum acceleration position.

5. A projectile accelerator as set forth in claim 1 which further comprises a first roller on said cam follower lever for rolling on a first surface of said cam follower to effect movement of said picking lever from said picking position to said end position thereof and a second roller on said cam follower lever for rolling on a second surface of said cam follower to effect movement of said picking lever from said intermediate position in said picking position.

6. A projectile accelerator as set forth in claim 1 wherein said tensioning means includes an eccentric rocker on said drive shaft and a tensioned lug on said accelerating shaft.

7. A projectile accelerator as set forth in claim 6 wherein said lug includes a groove and said tensioning means further includes a link pivotally mounted on said accelerating shaft and a pin connecting said eccentric rocker to said link, said pin being sized to engage in said groove of said lug.

8. A projectile accelerator as set forth in claim 6 wherein said lug includes an arcuate guide groove and said tensioning means further includes a pin on said rocker for engaging in said groove of said lug.

9. A projectile accelerator as set forth in claim 1 wherein said picking lever has a terminal member for impacting on a projectile during picking.

10. A projectile accelerator for a loom comprising a drive shaft;

a cam mounted on said drive shaft for rotation therewith;

an accelerating shaft parallel to said drive shaft;

a picking lever secured to and extending from said accelerating shaft for movement therewith from a picking position to an end position;

a pivotally mounted cam follower lever for following a first surface of said cam during rotation of said drive shaft;

a link connected to and between said cam follower lever and said picking lever, said link being movable from a first end position corresponding to said picking position to a second end position corresponding to said end position of said picking lever during movement of said cam follower lever with said first surface; and tensioning means connected to said drive shaft for rotating said accelerating shaft in a direction to move said picking lever from said end position thereof into a intermediate position toward said picking position and said link from said second end position toward said first end position thereof.

11. A projectile accelerator as set forth in claim 10 wherein said cam has a second surface for moving said cam follower lever from said picking lever from said intermediate position to said picking position thereof.

12. A projectile accelerator as set forth in claim 11 wherein said picking lever is movable through a maximum accelerating position between said end positions thereof and said link is movable into a position coaxial with said picking lever with said picking lever in said maximum acceleration position.

13. A projectile accelerator as set forth in claim 11 which further comprises a brake means to brake movement of said picking lever into said end position thereof.

14. A projectile accelerator as set forth in claim 10 wherein said tensioning means includes an eccentric rocker on said drive shaft and a tensioned lug on said accelerating shaft.

15. A projectile accelerator as set forth in claim 14 wherein said lug includes a groove and said tensioning means further includes a link pivotally mounted on said accelerating shaft and a pin connecting said eccentric rocker to said link, said pin being sized to engage in said groove of said lug.

16. A projectile accelerator as set forth in claim 14 wherein said lug includes an arcuate guide groove and said tensioning means further includes a pin on said rocker for engaging in said groove of said lug.

17. A projectile accelerator as set forth in claim 14 wherein said lug has a pin projecting therefrom and said rocker has an arcuate fork-like guide for receiving said pin.

18. A projectile accelerator as set forth in claim 6 wherein said lug has a pin projecting therefrom and said rocker has an arcuate fork-like guide for receiving said pin.

* * * * *

UNITED STATES PATENT AND TRADEMARK OFFICE

CERTIFICATE OF CORRECTION

PATENT NO. : 5,063,972

DATED : November 12, 1991

INVENTOR(S) : Erwin Pfarrwailer

It is certified that error appears in the above-identified patent and that said Letters Patent is hereby corrected as shown below:

Column 1, line 41, change "an" to --and--;

Column 4, line 42 & 43, change "betwee-none" to --between one-- line 59, change "mean" to --means--;

Column 6, line 4, change "a" to --an--.

Signed and Sealed this

Sixteenth Day of November, 1993

Bruce Lehman

*Attest:*

BRUCE LEHMAN

*Attesting Officer*

*Commissioner of Patents and Trademarks*